US010031440B2

(12) United States Patent
Nakamura et al.

(10) Patent No.: US 10,031,440 B2
(45) Date of Patent: Jul. 24, 2018

(54) DEVELOPING DEVICE AND IMAGE FORMING MEMBER INCLUDING A CLEARANCE CLOSING MEMBER WITH GROOVES

(71) Applicant: FUJI XEROX CO., LTD., Tokyo (JP)

(72) Inventors: Takashi Nakamura, Kanagawa (JP); Takashi Sakamoto, Kanagawa (JP); Munenobu Okubo, Kanagawa (JP); Takafumi Wakai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 250 days.

(21) Appl. No.: 14/874,803

(22) Filed: Oct. 5, 2015

(65) Prior Publication Data

US 2016/0238989 A1 Aug. 18, 2016

(30) Foreign Application Priority Data

Feb. 16, 2015 (JP) ..... 2015-027667

(51) Int. Cl.
*G03G 15/08* (2006.01)
*G03G 21/16* (2006.01)

(52) U.S. Cl.
CPC ..... *G03G 15/0815* (2013.01); *G03G 15/081* (2013.01); *G03G 15/0812* (2013.01); *G03G 15/0817* (2013.01); *G03G 15/0839* (2013.01); *G03G 15/0896* (2013.01); *G03G 15/0898* (2013.01); *G03G 21/1676* (2013.01); *G03G 2215/0805* (2013.01); *G03G 2215/0811* (2013.01); *G03G 2215/0813* (2013.01); *G03G 2215/0866* (2013.01)

(58) Field of Classification Search
CPC ..... G03G 15/081; G03G 15/0812; G03G 15/0817; G03G 15/0839; G03G 15/0896; G03G 15/0898; G03G 21/1676; G03G 2215/0805; G03G 2215/0811; G03G 2215/0813; G03G 2215/0866; G03G 15/0815
See application file for complete search history.

(56) References Cited

U.S. PATENT DOCUMENTS

2009/0110430 A1* 4/2009 Kubota ..... G03G 15/0898 399/103
2009/0154951 A1* 6/2009 Askren ..... G03G 15/0817 399/103
2014/0037326 A1* 2/2014 Hashimoto ..... G03G 21/0058 399/103
2016/0282754 A1* 9/2016 Kuramoto ..... G03G 15/0812

FOREIGN PATENT DOCUMENTS

JP 2009-244450 A 10/2009

* cited by examiner

*Primary Examiner* — Joseph S Wong
(74) *Attorney, Agent, or Firm* — Sughrue Mion, PLLC

(57) ABSTRACT

A developing device includes a supply member, a developing device body, and a closing member. The supply member supplies a developer to an image holding element that holds a developer image. The developing device body rotatably supports the supply member. The closing member closes a clearance formed between the developing device body and the supply member with one end of the closing member fixed to the developing device body and the other end, which is a free end, contacting the supply member. The closing member has plural grooves formed to extend from the other end toward the one end.

15 Claims, 5 Drawing Sheets

DEVELOPING DEVICE AND IMAGE FORMING MEMBER INCLUDING A CLEARANCE CLOSING MEMBER WITH GROOVES

CROSS-REFERENCE TO RELATED APPLICATIONS

This application is based on and claims priority under 35 USC 119 from Japanese Patent Application No. 2015-027667 filed Feb. 16, 2015.

BACKGROUND

Technical Field

The present invention relates to a developing device and an image forming apparatus.

SUMMARY

According to an aspect of the present invention, there is provided a developing device including: a supply member that supplies a developer to an image holding element that holds a developer image; a developing device body that rotatably supports the supply member; and a closing member that closes a clearance formed between the developing device body and the supply member with one end of the closing member fixed to the developing device body and the other end, which is a free end, contacting the supply member, in which the closing member has plural grooves formed to extend from the other end toward the one end.

BRIEF DESCRIPTION OF THE DRAWINGS

Exemplary embodiments of the present invention will be described in detail based on the following figures, wherein.

DETAILED DESCRIPTION

Now, exemplary embodiments of the present invention will be described in detail below with reference to the drawings.

Figure 1:
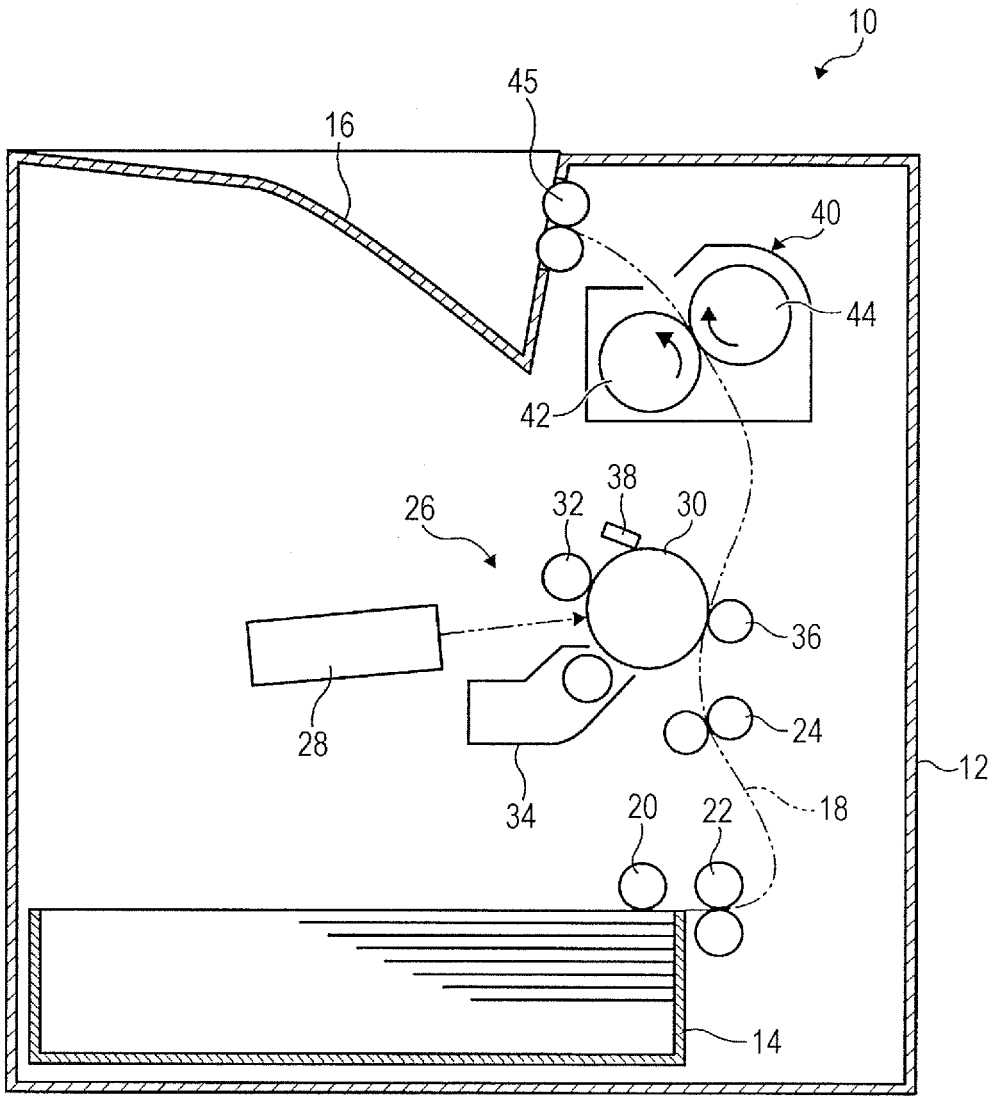
FIG. 1 is a schematic view of an image forming apparatus according to an exemplary embodiment of the present invention.

FIG. 1 is a schematic view illustrating an image forming apparatus 10 according to an exemplary embodiment of the present invention.

The image forming apparatus 10 includes an image forming apparatus body 12. A paper storing portion 14 is provided at the lower portion of the image forming apparatus body 12. A paper ejection portion 16 is provided at the upper portion of the image forming apparatus body 12. A large number of sheets of paper are stored in the paper storing portion 14. A paper transport path 18 is formed to extend from the paper storing portion 14 to the paper ejection portion 16.

A sheet disposed at the uppermost position of the paper storing portion 14 is fed by a pick-up roller 20, and handled by a transport roller 22 to be transported to the paper transport path 18. The transported sheet is temporarily stopped and restricted in position by a resist roller 24, and transported to an image forming portion 26 at a timing determined in advance.

The image forming portion 26 is composed of an optical writing device 28, an image holding element 30, a charging device 32, a developing device 34, a transfer roller 36, and a cleaning device 38. The optical writing device 28 emits laser light in synchronization with an image signal to form a latent image on the image holding element 30 charged by the charging device 32. The developing device 34 develops the latent image formed on the image holding element 30 using a developer. The developer image on the image holding element 30 is transferred to paper by the transfer roller 36. The developer remaining on the image holding element 30 is removed by the cleaning device 38 which is constituted of a blade, for example.

A fixing device 40 is composed of a heating roller 42 and a pressurizing roller 44, for example, and fixes the developer transferred to the paper to the paper using heat and a pressure. The paper to which the developer has been fixed by the fixing device 40 is ejected to the paper ejection portion 16 by an ejection roller 45.

Next, the developing device 34 will be discussed in detail.

Figure 2:
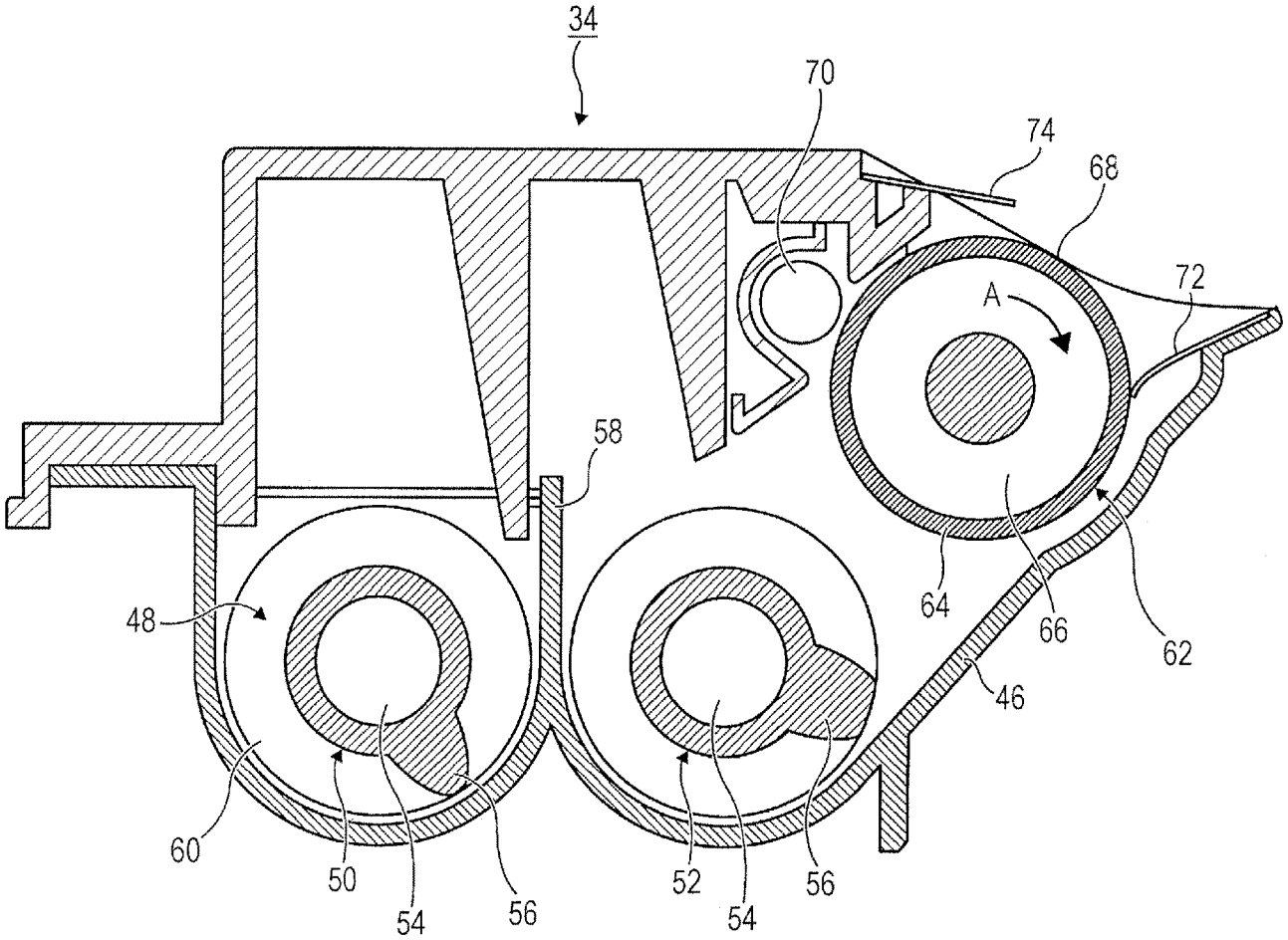
FIG. 2 is a vertical sectional view of a developing device according to the exemplary embodiment of the present invention.

FIG. 2 is a sectional view illustrating the developing device 34.

The developing device 34 is a two-component developing device that develops an image using a toner and a carrier. The developing device 34 includes a developing device body 46. The developing device body 46 is mountable to and removable from the image forming apparatus body 12. A storing portion 48 is formed at the lower portion of the developing device body 46. A first developer transport member 50 and a second developer transport member 52 are rotatably supported by the developing device body 46, and housed in the storing portion 48. The first developer transport member 50 and the second developer transport member 52 are each composed of a rotary shaft 54 and a spiral agitation/transport portion 56 formed around the rotary shaft 54. The first developer transport member 50 and the second developer transport member 52 are separated by a separation wall portion 58 formed at the middle of the storing portion 48 in the longitudinal direction. Opening portions (not illustrated) are formed on both sides of the separation wall portion 58 in the longitudinal direction. A transport path 60 through which the developer circulates is formed via the opening portions.

A developer supply port (not illustrated) connected to the transport path 60 is formed in the developing device body 46. A new toner is supplied from the developer supply port.

A developing roller (supply member) 62 is provided obliquely above the second developer transport member 52. The developing roller 62 is composed of a cylindrical sleeve 64 and a magnetic body 66 disposed in the sleeve 64. The sleeve 64 is formed from a non-magnetic material such as an aluminum alloy, and rotated in the clockwise direction, for example, as indicated by the arrow A in FIG. 2. The magnetic body 66 is composed of plural permanent magnets having different polarities and provided in the circumferential direction.

The sleeve 64 of the developing roller 62 is disposed to face the image holding element discussed earlier via a clearance determined in advance. A layer thickness restricting member 70 is provided upstream, in the rotational direction of the sleeve 64, of a supply portion (developing portion) 68 of the developing roller 62 that faces the image holding element. The layer thickness restricting member 70 restricts the layer thickness of a magnetic brush formed on the sleeve 64. A developer, the layer thickness of which has been restricted by the layer thickness restricting member 70, is supplied to the supply portion 68 to form a toner image on the image holding element.

In the configuration described above, the two-component developer is transported by rotation of the first developer transport member 50 and the second developer transport member 52 to circulate through the transport path 60. A new toner is supplied from above toward an end portion of the first developer transport member 50 via the developer supply port. The two-component developer is agitated while being transported through the transport path 60 so that the toner is charged. The two-component developer supplied by the second developer transport member 52 is attracted onto the sleeve 64 by the magnetic force of the magnetic body 66. The attracted two-component developer forms a so-called magnetic brush, and is rotated along with rotation of the sleeve 64. The layer thickness of the magnetic brush rotated on the sleeve 64 is restricted by the layer thickness restricting member 70. The magnetic brush with the restricted layer thickness contacts the image holding element, and the toner is supplied to an image forming portion of the image holding element by a Coulomb force.

A first closing member 72 is provided downstream of the supply portion 68. The first closing member 72 closes a clearance between the sleeve 64 and the developing device body 46 with one end of the first closing member 72 fixed to the developing device body 46 and with the other end contacting the sleeve 64. The first closing member 72 thus prevents the developer from leaking through the clearance because of swing of the image forming apparatus 10 during transport or the like, for example. The first closing member 72 is formed from a plastic film such as polyurethane, for example. The plastic film is a thin sheet of plastic with a thickness of less than 0.25 mm as defined by the JIS Packaging Vocabulary Standard.

A second closing member 74 is provided upstream of the supply portion 68 at both end portions in the axial direction. As with the first closing member 72, the second closing member 74 is formed from a plastic film. The second closing member 74 closes a clearance between the developing device body 46 and the image holding element 30 with one end of the second closing member 74 fixed to the developing device body 46 and with the other end contacting the image holding element 30. The second closing member 74 thus prevents the developer from leaking through the clearance.

The other end of the first closing member 72, which contacts the sleeve 64, is positioned more downstream, in the rotational direction of the sleeve 64, of the supply portion 68 than one end of the first closing member 72, which is fixed to the developing device body 46. Thus, when the sleeve 64 is rotated, a frictional force that pulls the first closing member 74 toward the downstream side of the sleeve 64 is applied to one end of the first closing member 74.

Figure 3:
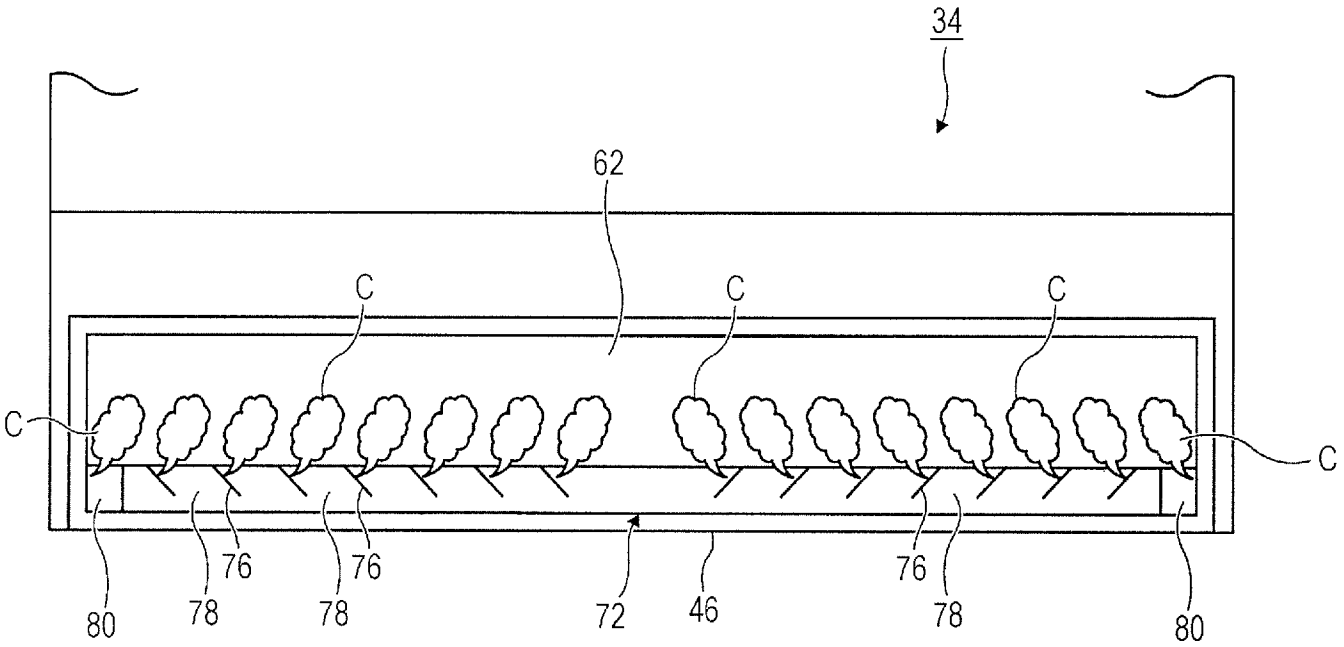
FIG. 3 is a plan view of the developing device according to the exemplary embodiment of the present invention.
Figure 4:
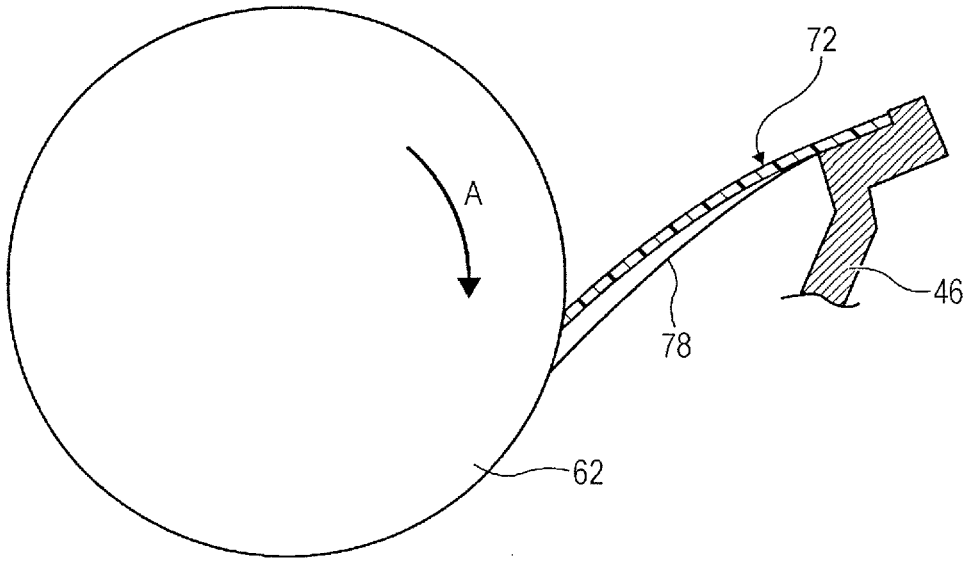
FIG. 4 is an enlarged sectional view of a particular portion of the developing device according to the exemplary embodiment of the present invention.

As illustrated in FIG. 3, a large number of cut grooves 76 are formed in the first closing member 72. The cut grooves 76 are formed by forming cuts in the first closing member 72. The cut grooves 76 are formed to extend obliquely toward the center of the developing roller 62 from the other end, at which the first closing member 72 contacts the sleeve 64, toward one end, at which the first closing member 72 is fixed to the developing device body 46. A divided portion 78 is formed between each cut groove 76 and an adjacent cut groove 76. With the cut grooves 76 formed to extend obliquely, the divided portions 78 are distorted obliquely with respect to the axial direction of the developing roller 62 when the sleeve 64 is rotated. Therefore, as illustrated in FIG. 4, the cut grooves 76 are opened obliquely toward the center of the developing roller 62 with the other end of the divided portion 78 in the axial direction of the developing roller 62 lowered with respect to one end of the divided portion 78.

In the developing device body 46, meanwhile, the pressure inside the developing device body 46 is increased with respect to the outside through rotation of the first developer transport member 50, the second developer transport member 52, and the sleeve 64, and the toner which is low-charged, in particular, is urged to be scattered out of the developing device body 46 as scattering toner C.

Opening portions 80 and 80 are formed at end portions of the first closing member 72 because of a tolerance etc. In the case where the cut grooves 76 are not provided, the scattering toner C is scattered in a concentrated manner through the opening portions 80 and 80. In the exemplary embodiment, the first closing member 72 is formed with the large number of cut grooves 76. Thus, the scattering toner C is scattered not only through the opening portions 80, 80 but also through the opening portions formed by the cut grooves 76.

The scattering toner C discharged via the cut grooves 76 causes no practical problem if the amount of the scattered toner is small, and adheres to the image holding element 30 to be collected by the cleaning device 38.

In the exemplary embodiment, further, the cut grooves 76 are opened toward the center of the developing roller 62 through rotation of the sleeve 64. Thus, the scattering toner C discharged through the cut grooves 76 is not directed toward the end portions of the developing roller 62, but discharged toward the center of the image holding element 30.

Figure 5:
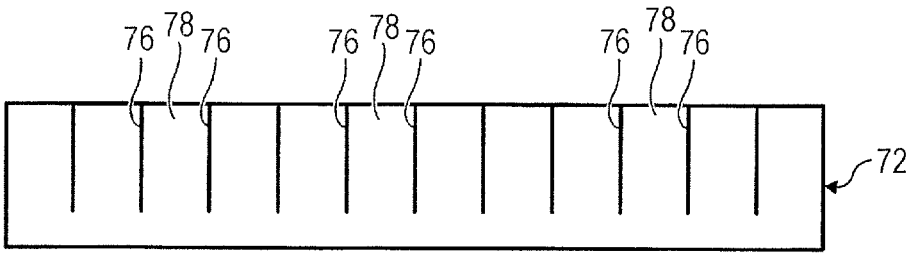
FIG. 5 is a plan view illustrating a closing member according to a second exemplary embodiment of the present invention.

FIG. 5 illustrates a closing member 72 according to a second exemplary embodiment.

In the closing member 72 according to the second exemplary embodiment, cut grooves 76 are formed to extend in a direction that is orthogonal to the axial direction of the developing roller 62.

Figure 6:
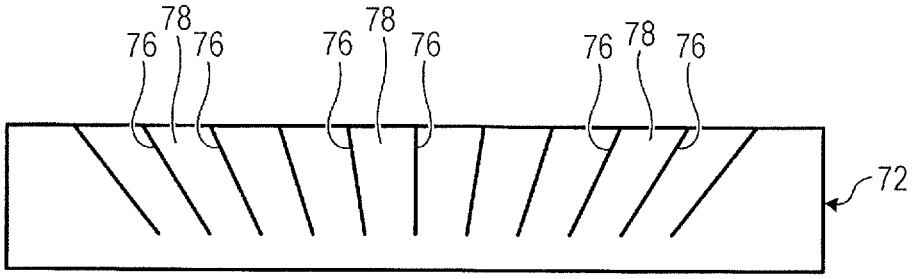
FIG. 6 is a plan view illustrating a closing member according to a third exemplary embodiment of the present invention.

FIG. 6 illustrates a closing member 72 according to a third exemplary embodiment.

In the closing member 72 according to the third exemplary embodiment, as in the first exemplary embodiment, cut grooves 76 are formed to extend obliquely. However, the direction of the cut grooves 72 is not uniform, and the cut grooves 72 are formed to extend at increasingly larger angles toward the end portions of the developing roller 62.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a supply member configured to supply a developer to an image holding element that is configured to hold a developer image;

a developing device body that rotatably supports the supply member; and a closing member configured to close a clearance formed between the developing device body and the supply member with a first end of the closing member fixed to the developing device body and a second end opposite the first end, which is a free end, configured to contact the supply member, wherein the closing member has a plurality of grooves extending from the second end toward the first end, wherein the grooves extend obliquely toward a center of the closing member in the axial direction of the supply member from the first end toward the second end, and wherein at least a portion of the closing member contacts the supply member at least at a center of the supply member in the axial direction.

2. The developing device according to claim 1, wherein the closing member is provided downstream, in a rotational direction of the supply member, of a supply portion of the supply member that is configured to supply the developer to the image holding element.

3. An image forming apparatus comprising:

an image holding element configured to hold a latent image; and a developing device configured to develop the latent image formed on the image holding element using a developer, wherein the developing device includes:

a supply member configured to supply the developer to the image holding element, a developing device body that rotatably supports the supply member, and a closing member configured to close a clearance formed between the developing device body and the supply member with a first end of the closing member fixed to the developing device body and a second end opposite the first end, which is a free end, configured to contact the supply member, and the closing member has a plurality of grooves extending from the second end toward the first end, wherein the grooves extend obliquely toward a center of the closing member in the axial direction of the supply member from the first end toward the second end.

4. The image forming apparatus according to claim 3, wherein the developing device is mountable to and removable from the image forming apparatus.

5. The developing device according to claim 1, wherein the grooves are provided only on a second end of the closing member, and the second end of the closing member does not contact the developing device body.

6. The developing device according to claim 1, wherein the grooves are in an open position in response to the supply member rotating and is in a closed position in response to the supply member being stationary.

7. The developing device according to claim 1, wherein the closing member is configured to contact the supply member such that at least a portion of the grooves contacts the supply member.

8. The image forming apparatus according to claim 3, wherein the grooves are provided only on a second end of the closing member, and the second end of the closing member does not contact the developing device body.

9. The image forming apparatus according to claim 3, wherein the grooves are in an open position in response to the supply member rotating and is in a closed position in response to the supply member being stationary.

10. The image forming apparatus according to claim 3, wherein the closing member is configured to contact the supply member such that at least a portion of the grooves contacts the supply member.

11. The developing device according to claim 1, wherein the grooves extend from a side of the second end toward the first end such that the grooves at the second end contact a surface of the supply member.

12. The developing device according to claim 1, wherein the grooves extend entirely through the closing member from a first surface, a portion of which contacts a supply roller, to a second surface, opposite the first surface.

13. The developing device according to claim 1, wherein the closing member is a straight flexible member and is configured to conform to a shape of the supply member.

14. The developing device according to claim 1, wherein at least a portion of the closing member is exposed at each end of the closing member in an axial direction of the supply member.

15. The developing device according to claim 1, wherein at least a surface of the closing member is exposed to an area enclosed within the developing device body.

* * * * *